United States Patent [19]

Lew et al.

[11] Patent Number: 4,598,792

[45] Date of Patent: Jul. 8, 1986

[54] SKY-RIDE VERTICAL MOBILITY SYSTEM

[76] Inventors: Hyok S. Lew; Hyon S. Lew; Yon K. Lew, all of 7890 Oak St., Arvada, Colo. 80005

[21] Appl. No.: 682,673

[22] Filed: Dec. 17, 1984

Related U.S. Application Data

[63] Continuation-in-part of Ser. No. 676,400, Nov. 30, 1984, Pat. No. 4,598,793.

[51] Int. Cl.[4] ..... A62B 1/08

[52] U.S. Cl. ..... 182/42; 182/5; 182/72

[58] Field of Search ..... 182/42, 4–7, 182/231, 75, 236, 240, 71, 72, 190–193, 43; 188/65.1–65.5

[56] References Cited

U.S. PATENT DOCUMENTS

| | | | |
|---|---|---|---|
| 290,076 | 12/1883 | Lewis | 188/65.4 |
| 1,212,301 | 1/1917 | Wick | 182/6 |
| 3,759,346 | 9/1973 | Brda | 182/7 |

FOREIGN PATENT DOCUMENTS

| | | | |
|---|---|---|---|
| 542390 | 12/1931 | Fed. Rep. of Germany | 182/5 |

*Primary Examiner*—Reinaldo P. Machado
*Assistant Examiner*—Alvin Chin-Shue

[57] ABSTRACT

This invention relates to a self-contained and self-sufficient device for lowering and raising oneself vertically without relying on any mechanical power, or any man power external to the system wherein the direction and speed in the vertical movement of a person is fully controlled with ease by that person himself or herself. The sky-ride vertical mobiity system of the present invention comprises a frictionally controlled rope release device secured to an upper level and a closed loop of rope depending from the frictionally controlled rope release device that is wrapped around a friction drum included in the frictionally controlled rope release device. Exertion of a pull of very small magnitude on one member of the closed loop of rope depending from the frictionally controlled rope release device creates a frictional braking of very large magnitude that is capable of suspending a heavy object secured to the other member of the closed loop of rope motionlessly in mid-air or lower it at a safe speed. A person secured to one member of the closed loop of rope by means of a harness worn by that person and secured to one member of the closed loop of rope can control his or her own descending motion by exerting small amount of pull on the other member of the closed loop of rope and varying thereof. The sky-ride vertical mobility system including a one-way frictionally controlled rope release device with a friction drum equipped with a ratchet mechanism enables one to raise himself or herself by using a harness secured to one member of the closed loop of rope depending from the one-way frictionally controlled rope release device and a stirrup equipped with a one-way grip slidably engaged by the other member of the closed loop of rope depending from the one-way frictionally controlled rope release device.

8 Claims, 25 Drawing Figures

SKY-RIDE VERTICAL MOBILITY SYSTEM

This patent application is a continuation-in-part application to patent application Ser. No. 06/676400, now U.S. Pat. No. 4,598,793, issued 7/8/86 entitled "Sky-Ride Emergency Escape System" filed on Nov. 30, 1984.

BACKGROUND OF THE INVENTION

There is a great demand for a self-contained and self-sufficient portable device that enables a person to lower oneself vertically with ease from an elevated structure of great height. Such a device can be used in escaping from a burning high-rise building or from the deck of a large sea-going vessel during an emergency. There is also a demand for a self-contained and self-sufficient portable device that enables a person to raise oneself vertically to an elevated structure of a great height without physically exhausting oneself. The light weight portable device with aforementioned capability can be used as a fire escape system from high-rise buildings, means for transporting personel from one level to another level during an emergency, and as a tool assisting mountain climbers, spelunkers, rescue crews, construction workers, military training and operations, etc. Such a device also makes an excellent recreational aid for people enjoying outdoor activities.

The primary object of the present invention is to provide a self-contained and self-sufficient light weight device enabling a person to lower oneself vertically with ease from a height ranging from a score of feet up to a few thousand feet.

Another object is to provide a self-contained and self-sufficient light weight device enabling a person to raise oneself without physically struggling to a height ranging from a score of feet to a few thousand feet.

A further object is to provide a vertical mobility system comprising a closed loop of rope depending from a frictionally controlled rope release device including a friction drum that is wrapped around over a plurality of laps by a portion of said closed loop of rope.

Still another object is to provide a vertical mobility system wherein the looping motion of the closed loop of rope depending from a frictionally controlled rope release device, that is created by the weight secured to one member of the closed loop of rope, is controlable by a small amount of pull exerted on the other member of the closed loop of rope.

Still a further object is to provide a vertical mobility system capable of raising a person that comprises a closed loop of rope depending from a one-way frictionally controlled rope release device wherein one member of said closed loop of rope depending from the one-way frictionally controlled rope release device includes a harness removably secured thereto and the other member of the closed loop of rope depending from the one-way frictionally controlled rope release device slidably engages a stirrup assembly equipped with a one-way grip.

Yet another object is to provide a frictionally controlled rope release device wherein the magnitude of the frictional braking on the looping motion of the closed loop of rope depending therefrom that is created by a larger tension on one member of the closed loop of rope is substantially proportional to a smaller tension on the other member of the closed loop of rope.

Yet a further object is to provide a frictionally controlled rope release device wherein the magnitude of the frictional braking on the looping motion of the closed loop of rope depending therefrom is substantially proportional to the difference in tensions imposed on the two members of the closed loop of rope depending from the frictionally controlled rope release device.

These and other objects of the present invention will become clear as the description thereof proceeds.

BRIEF DESCRIPTION OF THE FIGURES

The present invention may be described with a greater clarity and specificity by referring to the following figures.

DESCRIPTION OF THE ILLUSTRATED EMBODIMENTS

Figure 1:
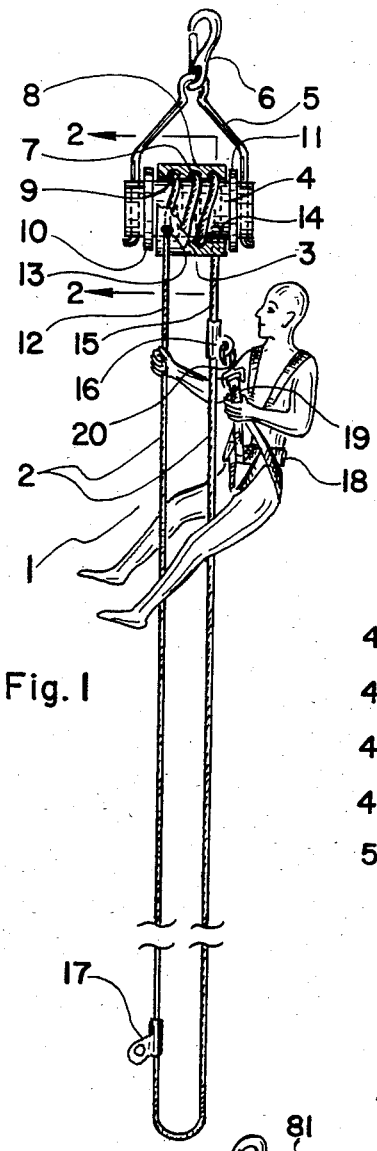
FIG. 1 illustrates a schematic drawing showing the construction and operating principles of a sky-ride vertical mobility system of the present invention, that enables a person to lower oneself with ease.

In FIG. 1 there is illustrated a schematic drawing showing the construction and operating principles of one-way sky-ride vertical mobility system 1 constructed in accordance with the principles of the present invention, which system is designed to lower oneself from an upper level to a lower level, but does not enable one to raise oneself from a lower level to an upper level. The one-way vertical mobility system 1 comprises a closed loop of rope 2 depending from a two-way frictionally controlled rope release device 3. The two-way frictionally controlled rope release device 3 comprises a frictional drum 4 nonrotatably supported by a yoke-structure or U-bolt 5 equipped with a securing means 6 such as a snap hook. A portion 7 of the closed loop of rope 2 wraps around the mid-section of the friction drum 4 over at least one complete lap. A guide sleeve 8 including a helical groove 9 disposed in the inside surface thereof is rotatably engaged by the mid-section of the friction drum 4 wherein a pair of flanges 10 and 11 affixed to the friction drum 4 rotatably retains the guide sleeve 8 in position. One member 12 of the closed loop of rope 2 slidably engages and extends through one guide hole 13 disposed through the wall of the guide sleeve 8, whereupon it is routed following the helical groove 9 included in the guide sleeve and wrapped around the mid-section of the friction drum 4. After completing at least one complete lap around the midsection of the friction drum 4, the portion 7 of the closed loop of rope 2 slidably engages and extends through the other guide hole 14 disposed through the wall of the guide sleeve 8, whereupon it emerges as the other member 15 of the closed loop of rope. The rope member 15 of the closed loop of rope 2 depending from the two-way frictionally controlled rope release device 3 includes a securing means 16 such as a a closed ring or hook affixed thereto. The rope member 12 of the closed loop of rope 2 includes a securing means 17, affixed thereto at a position in such a way that, when the securing means 16 is pulled up near to the upper extremity of the vertical mobility system 1, the securing means 17 is located near to the lower extremity of the vertical mobility system 1 and vice versa.

The frictional resistance against the looping motion of the closed loop of rope 2 provided by the frictionally controlled rope release device 3 is approximately equal to $$F = T_S(e^{\mu\theta} - 1),$$

where F is the frictional braking on the looping motion, $T_S$ is the smaller of two tensions imposed on two members 12 and 15 of the closed loop of rope, e is the base of the natural logarithm, $\mu$ is the friction coefficient between the rope element and the surface of the friction drum 4 and $\theta$ is the lap angle of the rope wrapped around the friction drum measured in radians. In general, the quantity $(e^{\mu\theta} - 1)$ is large number. For example, when the friction coefficient is equal to 0.25 and the lap angle is equal to three complete laps, $(e^{\mu\theta} - 1)$ is equal to 110. In other words, a small pull exerted on one rope member is able to hold a large weight secured to the other rope member that is one hundred ten times greater than the small tension on one rope member. Now, it is clear that a person wearing a harness 18 that is secured to one rope member 15 by means of a tether 19 with a securing means 20 such as a snap hook clasped on the securing means 16 affixed to the rope member 15, can hold oneself in midair or lower oneself at a safe speed by exerting a small amount pull on the other rope member 12 and controlling thereof, which small amount of pull is equal to only a few percent of one's own weight. The person secured to one rope member 15 may lower oneself by using a hand-over-hand motion in grabbing the other rope member 12 or by allowing the other rope member 12 to slide through one's gentle grip on the other rope member. When a first person lowers oneself to a lower level and removes the clasp means 20 from the securing means 15, the other securing means 17 is automatically positioned at the upper level and, consequently, a second person wearing a harness same as the element 18 secures oneself to the rope member 12 and lowers oneself by releasing the rope member 15 in a controlled manner. Therefore, the vertical mobility system 1 enables a plurality of persons to lower themselves one by one in a continuous operation. It is clear that a third person located at the upper level or lower level, who has access to the rope members depending from the frictionally controlled rope release device, is able to control the descending motion of a person by grabbing and releasing the rope member in a controlled manner, which rope member is the counter part of the other rope member supporting the person being lowered.

Figure 2:
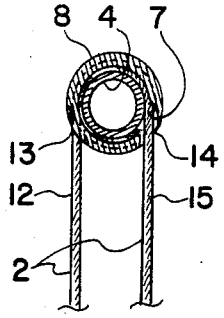
FIG. 2 illustrates a cross section of the two-way frictionally controlled rope release device included in the sky-ride vertical mobility system shown in FIG. 1.

In FIG. 2 there is illustrated a cross section of the two-way frictionally controlled rope release device 3 shown in FIG. 1 which is taken along a plane 2—2 as shown in FIG. 1. It should be understood that the frictional braking on the looping motion of the closed loop of rope 2 is provided by the friction resulting from the gripping action of the rope member on the nonrotatably secured friction drum 4. The guide sleeve 8 merely confines in a sliding relationship the portion 7 of the closed loop of rope 2 within an annular cylindrical space intermediate the friction drum 4 and the guide sleeve 8. The helical groove 9 provides a helical path for the portion 7 of the closed loop of rope 2 wrapped around the friction drum 4. It should be further understood that neither the friction drum 4 nor the guide sleeve 8 rotates during the looping movement of the closed loop of rope 2.

Figure 3:
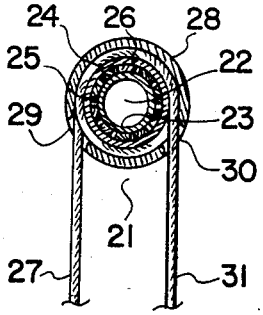
FIG. 3 illustrates a cross section of another embodiment of the frictionally controlled rope release device.

In FIG. 3 there is illustrated a cross section of another two-way frictionally controlled rope release device 21 taken along a plane perpendicular to the central axis of the friction drum assembly 22. The friction drum assembly 22 comprises a rigid circular cylindrical member 23 nonrotatably secured to a yoke structure such as the element 5 shown in FIG. 1; a plurality of brake pads 24, 25, etc. assembled into a hollow cylindrical shell or a squeezable brake lining, which are disposed around the outer cylindrical surface of the cylindrical member 23; and an elastic sleeve 26 encasing the combination of the cylindrical member 23 and the squeezable brake lining assembly of the brake pads 24, 25, etc. in a water-proof fashion. One rope member 27 of the closed loop of rope enters the annular cylindrical space between the friction drum assembly 22 and the guide sleeve 28 through a guide hole 29 disposed through the wall of the guide sleeve 28, and is wrapped around the friction drum assembly 22 and exits through another guide hole 30 disposed through the wall of the guide sleeve 28, whereupon it emerges as the other rope member 31 of the closed loop of rope depending from the two-way frictionally controlled rope release device 21. The relative motion providing the frictional braking takes place exclusively at the interface between the inner cylindrical surface of the squeezable brake lining assembly of the brake pads and the outer cylindrical surface of the cylindrical member 23. The rope element wrapped around the friction drum assembly 22 does not experience any slipping motion relative to the cylindrical surface of the elastic sleeve 26 and, consequently, the rope element of the closed loop of rope is protected from abrasive wear. As the braking surface is encased within the elastic sleeve 26 in a water-proof fashion, the friction drum assembly provides a consistent braking performance independent of the conditions of the working environment. It should be understood that the two-way frictionally controlled rope release device 21 functions well without the elastic sleeve 26. When the wear of the rope element and the water-proofing of the friction drum assembly are not critical issues, the elastic sleeve 26 may be omitted in constructing a friction drum assembly 22.

Figure 4:
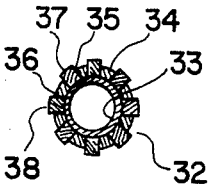
FIG. 4 illustrates a cross section of a friction drum included in a further embodiment of the frictionally controlled rope release device.
Figure 22:
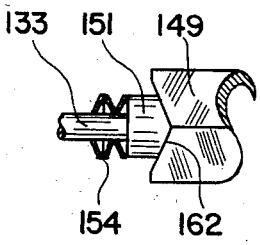
FIG. 22 illustrates still another cross section of the device shown in FIG. 18.

In FIG. 4 there is illustrated a cross section of a further friction drum assembly 32 that can replace the friction drum assemblies 4 of FIG. 2 or 22 of FIG. 3. The friction drum 32 comprises; a cylindrical member 33 nonrotatably secured to a supporting structure; a hollow cylinder 34 including a plurality of cut-outs 35, 36, etc. that is rotatably engaged by the cylindrical member 34; and a plurality of the brake pads 37, 38, etc. slidably confined within the plurality of the cut-outs 35, 36, etc. The rope member of the closed loop of rope may be directly wrapped around the friction drum assembly 32. The friction drum assembly 32 may be encased within an elastic sleeve such as the element 26 of FIG. 3 and, then, the rope member may be wrapped therearound.

Figure 5:
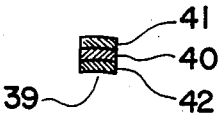
FIG. 5 illustrates a cross section of a brake pad usable in conjunction with the friction drum shown in FIG. 3.

In FIG. 5 there is shown a cross section of a brake pad 39 comprising an elastic layer sandwiched between a pair of rigid brake linings 41 and 42. When a plurality of cushioned brake pads such as the element 39 are employed in the construction of a friction drum 32 shown in FIG. 4 in place of those brake pads 37, 38, etc., the magnitude of the frictional braking provided by a frictionally controlled rope release device can be limited to a preset maximum value. With a friction drum constructed as shown in FIG. 2 or 3, the frictional braking force increases without limit as the smaller of two tensions imposed on two members of the closed loop of rope increases. As long as the weight of the closed loop of rope depending from the frictionally controlled rope release device is not significantly heavy, the friction drum constructed as shown in FIG. 2 or 3 works fine. However, they cannot be used in conjunction with a very heavy closed loop of rope such as stainless steel wire ropes of sizable diameter depending from a frictionally controlled rope release device over a great height, for the weight of the rope member itself creates too much frictional braking which locks up the vertical mobility system stranding the person to be lowered in midair. Such a problem does not exist with a frictionally controlled rope release device employing the friction drum 32 of FIG. 4 equipped with cushioned brake pads 39 shown in FIG. 5. The maximum value of the frictional braking takes place when the tension on the rope element wrapped around the friction drum assembly 32 squeezes down the cushioned brake pads flush to the outer cylindrical surface of the hollow cylinder 34. A further increase in the tension on the rope element wrapped around the friction drum assembly 32 does not increase the magnitude of the frictional braking beyond the preset maximum value because the additional tension does not squeeze the cushioned brake pads any further down below the outer cylindrical surface of the hollow cylinder 34. Once the maximum value of the frictional braking is set to a value such as ten pounds less than the weight of the person to be lowered, a vertical mobility system employing a friction drum of construction shown in FIG. 4 equipped with cushioned brake pads enables a person to lower oneself over any height without being hampered by the weight of the closed loop of rope employed therein.

Figure 6:
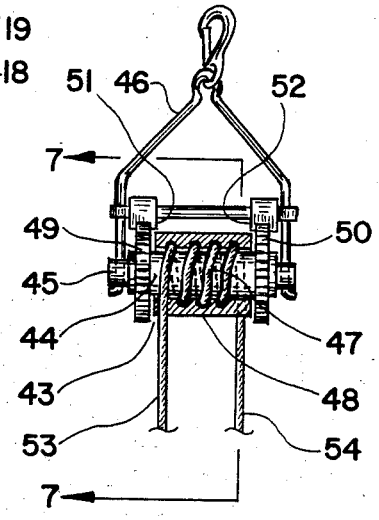
FIG. 6 illustrates a one-way frictionally controlled rope release device.

In FIG. 6 there is illustrated a cross section of a one-way frictionally controlled rope release device 43 comprising a friction drum 44 rotatably supported by a shaft 45 that is secured to a support structure 46. The rope element 47 wrapped around the friction drum 44 is guided by the guide sleeve 48 having the same construction and function as the element 8 shown in FIG. 1. A pair of ratchet wheels 49 and 50 respectively affixed to the two extremities of the friction drum 44 and respectively checked by a pair of retchet stops 51 and 52, allow the friction drum 44 to rotate freely in one direction relative to the supporting structure 46, while the friction drum 44 is not rotatable relative to the supporting structure 46 in the other direction. Consequently, the rope element 53 can be pulled down without being hindered by the frictional braking, while the pulling down of the rope element 54 is subjected to the frictional braking. For this reason, the device 43 is called a one-way frictionally controlled rope release device.

Figure 7:
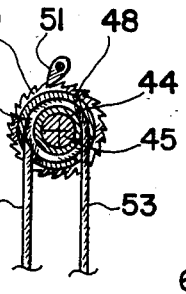
FIG. 7 illustrates a cross section of the one-way frictionally controlled rope release device shown in FIG. 6.

In FIG. 7 there is illustrated a cross section of the one-way frictionally controlled rope release device 43 shown in FIG. 6, which further illustrates the ratchet wheel 49 checked by a ratchet stop 50 that allows the friction drum 44 to rotate freely in a counter-clockwise direction and prevents any rotation in a clockwise direction in the specific embodiment shown in FIG. 7. It should be mentioned that there are many other designs of ratchet mechanisms, which can be employed in place of the specific embodiment included in FIGS. 6 and 7. It is quite clear that the friction drum illustrated in FIGS.

3 or 4 may be employed in place of the element 44 in constructing the one way frictionally controlled rope release device 43.

Figure 8:
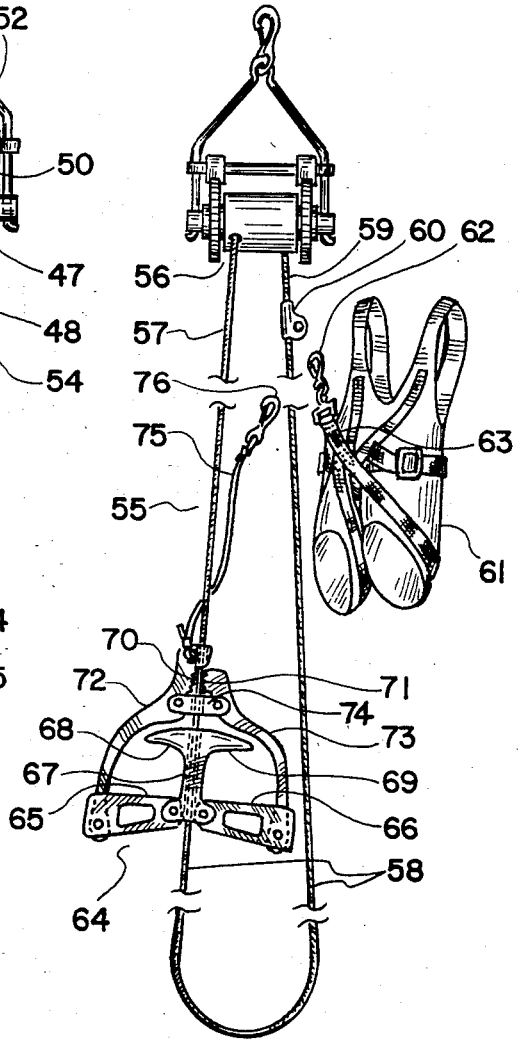
FIG. 8 illustrates a schematic drawing showing the construction and operating principles of another sky-ride vertical mobility system, that enables a person to lower oneself as well as to raise oneself.

In FIG. 8 there is illustrated a schmatic drawing showing the construction and operating principles of a two-way sky-ride vertical mobility system 55 that employs the one-way frictionally controlled rope release device 56 having the same construction as the device 43 shown in FIG. 6. The rope member 57 of the closed loop of rope 58 can be pulled down freely without being hindered by the frictional braking, while pulling down of the rope member 59 is subjected to the frictional braking imposed by the friction drum assembly included in the one-way frictionally controlled rope release device 56. The rope member 59 depending from the frictionally controlled rope release device 56 includes a securing means 60 such as a ring or snap hook affixed thereto. A harness 61 securable to the torso of a person can be secured to the securing means 60 by means of a clasp means 62 affixed to an extremity of a tether 63 extending from the harness 61. The rope member 57 includes a stirrup assembly 64 including a pair of foot-rests 65 and 66 hinged to a foot-rest holder 67 including a pair of foot-catches 68 and 69. The combination of the foot-rests and the foot-rest holder functions as a toggle joint that activates and deactivates the pair of gripping jaws 70 and 71 respectively included in a pair of stirrup frames 72 and 73 simultaneously connected to the hinge member 74 and the pair of foot-rests 65 and 66 in hinged relationship, respectively. The rope member slidably engages and extends through the guide holes disposed through one stirrup frame 72, the hinge member 74 and the foot-rest holder 67. The stirrup 64 includes a tether 75 extending therefrom that includes a clasping means 76 secured to the free end of the tether 75.

A person wearing the harness 61 secures oneself to the rope member 59 by clasping the clasp means 62 onto the securing means 60 affixed to the rope member 59, who also secures the stirrup assembly 64 to the securing means 60. This person can hold oneself in midair or lower oneself by simply grabbing the other rope member 57 and exerting a small amount of pull thereon. The stirrup assembly 64 slides over the rope member 57 freely as long as there is no pressure on the foot-rests 65 and 66. As a consequence, the stirrup assembly 64 slides down freely with the person lowering oneself as long as that person does not stand on the foot-rests. In order to raise oneself with the vertical mobility system 55, the person secured to the rope member 59 first places both feet on the foot-rests 65 and 66, and stands thereon, whereupon the stirrup assembly locks onto the rope member 57 as the gripping jaws 70 and 71 are activated by the pressure exerted on the toggle joint comprising the pair of foot-rests 65 and 66. When one stands on the pair of foot-rests 65 and 66 included in the stirrup assembly 64 that locks on the rope member 57, the major portion of the body weight shifts from the rope member 59 to the rope member 57 and, consequently, the rope member 57 comes down and the rope member 59 goes up, as the looping movement of the closed loop of rope 58 in such a direction is unhindered by the frictional braking because of the ratchet mechanism included in the one-way frictionally controlled rope release device 56. By repeating the movement of sitting down by lifting the legs that pulls up the stirrup assembly 64 and standing up on feet resting on the stirrup assembly 64 while executing the hand-over-hand movement wherein a small amount of pull is exerted on the rope member 57, one can raise oneself with great ease. The two-way vertical mobility system 55 shown in FIG. 8 is a very handy tool for mountain climbers, spelunkers, fire and rescue crews, military personnel and outdoor activists.

Figure 9:
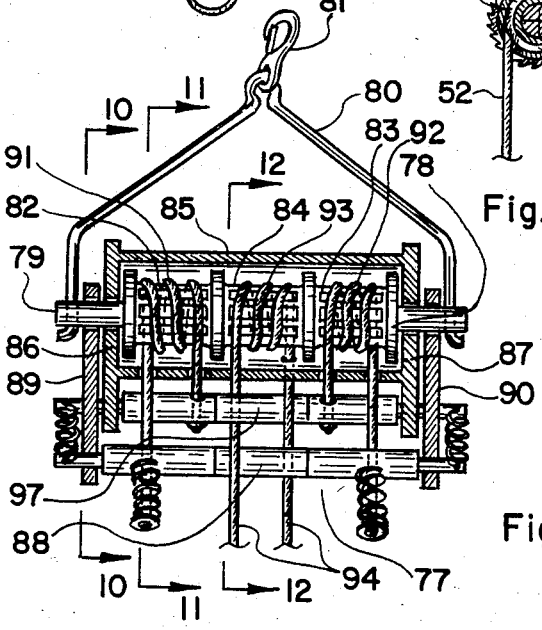
FIG. 9 illustrates a cross section of a frictionally controlled rope release device wherein the braking force is substantially proportional to the difference in tensions imposed on the two members of the closed loop of rope depending therefrom.

In FIG. 9 there is illustrated a cross section of a one-way frictionally controlled rope release device 77 taken along a plane including the central axis of the friction drum assembly 78 rotatably engaged by a shaft 79 that is secure to a supporting structure 80 including a securing means 81. Two extremities of the friction drum assembly include a pair of the brake drums 82 and 83, respectively, while the midsection includes the capstan drum 84. Aforementioned three sections of the friction drum assembly 78 are coaxially disposed and rigidly interconnected. The entire friction drum assembly 78 is encased within a guide sleeve 85 including a pair of end plates 86 and 87, which combination is rotatably supported by the shaft 79. The plurality of guide holes providing passages for a plurality of rope elements are disposed through the cylindrical wall of the guide sleeve 85. A roller 88 is rotatably secured to the lower extremities of a pair of arms 89 and 90 depending from the shaft 79 in a pendulous relationship. The pair of brake drums 82 and 83 are respectively wrapped around by a pair of brake ropes 91 and 92, while the capstan drum 84 is wrapped around by the rope element 93 of the closed loop of rope 94 depending from the one-way frictionally controlled rope release device 77.

Figure 10:
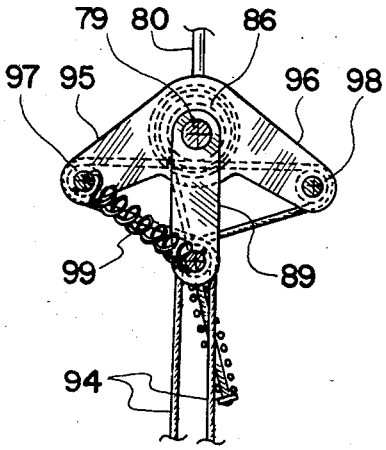
FIG. 10 illustrates a cross section of the device shown in FIG. 9.

In FIG. 10 there is illustrated a cross section of the one-way frictionally controlled rope release device 77 shown in FIG. 9, that is taken along a plane 10—10 as shown in FIG. 9. One end plate 86 of the guide sleeve 85 includes a pair of arms 95 and 96 extending in substantially two opposite directions, which respectively support a pair of rollers 97 and 98 rotatably secured to the extremities thereof. The other end plate 87 of the guide sleeve 85 also includes a pair of arms extending in substantially two opposite directions, which respectively support the rollers 97 and 98 in a rotatable relationship, too. The extremity of the arm 95 extending from the end plate 86 of the guide sleeve 85 is spring biased to the extremity of the arm 89 rotatably depending from the shaft 79 by a tension spring 99. The other extremity of the one-way frictionally controlled rope release device 77 also includes another tension spring installed in a relation equivalent to the tension spring 99.

Figure 11:
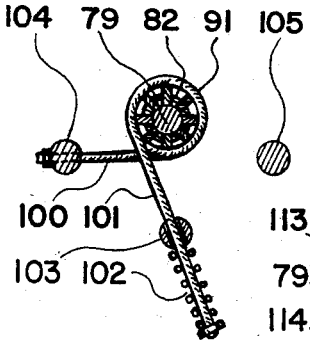
FIG. 11 illustrates another cross section of the device shown in FIG. 9.

In FIG. 11 there is illustrated another cross section of the one-way frictionally controlled rope release device 77 shown in FIG. 9, which is taken along a plane 11—11 as shown in FIG. 9. The brake drum 82 wrapped around by the brake rope 91 has the same construction and functions as the friction drum 32 shown in FIG. 4 and described in conjunction therewith. The one extremity 100 of the brake rope 91 is affixed to a shaft 104 rotatably supporting the roller 97, while the other extremity 101 is secured to the shaft 103 rotatably supporting the roller 88 in a spring biased relationship wherein a compression spring 102 is included. The shaft 105 rotatably supports the roller 98. The combination comprising the other brake drum 83 and the other brake rope 92 as shown in FIG. 9 is arranged in the same way as its counter part shown in FIG. 11.

Figure 12:
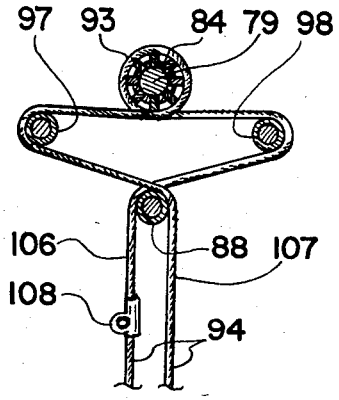
FIG. 12 illustrates a further cross section of device shown in FIG. 9.

In FIG. 12 there is illustrated a further cross section of the one-way frictionally controlled rope release device 77 shown in FIG. 9, which is taken along a plane 12—12 as shown in FIG. 9. The capstan drum 84 wrapped around by the rope element 93 of the closed loop of rope 94 has the same construction and functions as the friction drum 32 of FIG. 4 equipped with cushioned brake pads 39 shown in FIG. 5, wherein the frictional braking imposed by the capstan drum assembly cannot exceed a preset maximum value. One rope member 107 of the closed loop of rope 94, that is an extension of the rope element 93 wrapped around the capstan drum 84, departs the capstan drum 84 in clockwise direction and is routed around the roller 97 in a counterclockwise direction and around the roller 88 in a clockwise direction. The rope member 106 of the closed loop of rope 94, which is another extension of the rope element 93 wrapped around the capstan drum 84, departs the capstan drum 84 in a counter-clockwise direction and is routed around the roller 98 in a clockwise direction and around the roller 88 in a counterclockwise direction. The rope member 106 includes a securing means 108 such as a ring or snap hook affixed thereto.

It becomes evident from FIG. 12 that, firstly, pulls on the rope members 106 and 107 creates a frictional braking of magnitude equal to or less than a preset maximum value and, secondly, the combination of rollers 97 and 98 pivots about the shaft 79 relative to the roller 88 in either direction when the pulls on the two rope members 106 and 107 are not equal wherein the magnitude of pivoting movement measured from the neutral position as shown in FIG. 12 is substantially proportional to the magnitude of the difference in pulls exerted on two rope members 106 and 107 because of the spring bias 99 against such a pivoting movement as shown in FIG. 10. When a person wearing a harness such as the element 61 shown in FIG. 61 that is secured to the securing means 108 affixed to rope member 106, secures oneself to the rope member 106, a pivoting movement of the combination of the follers 97 and 98 relative to the roller 88 takes place in a clockwise direction about the shaft 79 wherein the magnitude of the pivoting movement is substantially porportional to the weight of the person secured to the rope member 106. It becomes clear from FIG. 11 that such a pivoting movement pivots away the shaft 104 anchoring one extremity 100 of the brake rope 91 from the shaft 103 spring biasedly securing the other extremity 101 of the brake rope 91, which movement tightens the grip of the brake rope 91 on the brake drum 82 and, consequently, creates a frictional braking on the rotational motion of the friction drum assembly 78 wherein the magnitude of the frictional braking is substantially proportional to the weight of the person secured to the rope member 106. Now, it is clear that the brake drums 82 and 83 included in the one-way frictionally controlled rope release device 77 shown in FIG. 9 generates a frictional braking force wherein the magnitude thereof is substantially proportional to the magnitude of the difference between the tensions imposed on the two rope members depending from the one-way frictionally controlled rope release device 77. The frictionally controlled rope release device 77 is a one-way control device because the brake drums 82 and 83 do not generate any frictional braking when the tension on the rope member 107 is greater than the tension on the rope member 106 because there is no brake rope routed between the shafts 103 and 105. Therefore, the one-way frictionally controlled rope release device 77 shown in FIG. 9 operates much like the one-way frictionally controlled rope release device 43 shown in FIG. 6. Of course, the magnitude of the frictional braking imposed by the device 77 is substantially proportional to the magnitude of the difference between the tensions imposed on the two rope members, while the device 43 generates a frictional braking of magnitude substantially proportional to the smaller of the two tensions imposed on the two rope members. It is quite clear that the one-way frictionally controlled rope release device 77 can replace the frictionally controlled rope release device 56 in constructing a two-way vertical mobility system 55 shown in FIG. 8. It should be understood that a two-way vertical mobility system such as the apparatus 55 shown in FIG. 8 can always be used as a one-way vertical mobility system for lowering a person or an object, when the stirrup assembly 64 is omitted, wherein the securing means 60 affixed on the rope member 59 has to be raised back to the upper level by pulling down the rope member 57 after completion of each descent. It should be mentioned that, when the weight of the closed loop of rope is small and the vertical distance covered by the vertical mobility system is not too great, the one-way frictionally controlled rope release device 43 shown in FIG. 6 should be employed in constructing two-way vertical mobility system while the one-way frictionally controlled rope release device 77 shown in FIG. 9 should be used when the closed loop of rope is heavy and the vertical distance to be covered is great.

Figure 13:
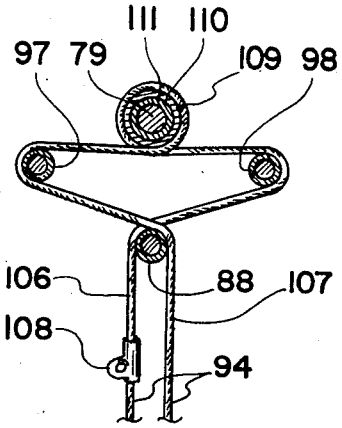
FIG. 13 illustrates a cross section of another embodiment of the friction drum that can be incorporated into the device shown in FIG. 9.

In FIG. 13 there is illustrated a cross section of another embodiment of the capstan drum 109 that can be used in place of the capstan drum 84 shown in FIG. 12. The capstan drum 109 comprises a simple rigid hollow cylinder rotatably mounted on the shaft 79 by means of a bearing 111. Of course, the capstan drum 109 provide little frictional braking, while the capstan drum 84 of FIG. 12 provides frictional braking equal to or less than a preset maximum value.

Figure 14:
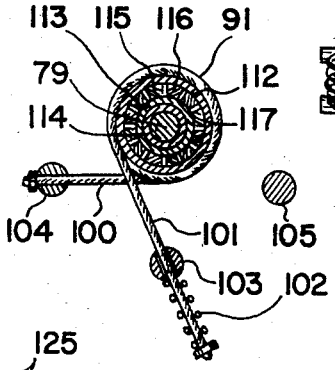
FIG. 14 illustrates a cross section of a further embodiment of the friction drum that can be incorporated into the device shown in FIG. 9.

In FIG. 14 there is illustrated a cross section of another embodiment of the brake drum 112 that can be employed in place of the brake drum 82 shown in FIG. 11. The brake drum 112 comprises a hollow cylinder 113 rotatably mounted on the shaft 79 by means of a bearing 114 and a plurality of brake pads 115, 116, etc. assembled into a collapsible tubular structure tightly encircling the hollow cylinder 113. The aforementioned combination may be encased within an elastic sleeve 117 water-proofing the brake drum assembly.

Figure 15:
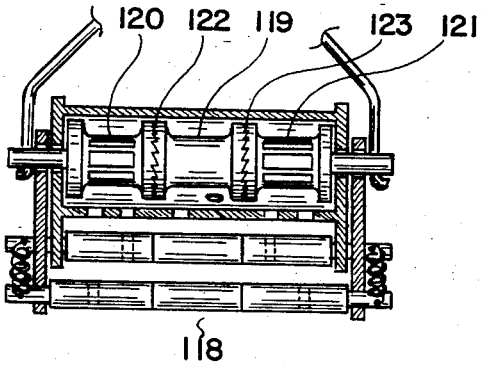
FIG. 15 illustrates a cross section of a one-way frictionally controlled rope release device including ratchet mechanisms.

In FIG. 15 there is illustrated a cross section of another one-way frictionally controlled rope release device 118 constructed essentially in the same way as the device 77 shown in FIG. 9 with an exception being that the capstan 119 employing a simple hollow cylinder as shown in FIG. 113 is mechanically linked to the pair of brake drums 120 and 121 by a pair of ratchet mechanisms 122 and 123, respectively. This embodiment provides nearly frictionless looping of the closed loop of rope depending from the one-way frictionally controlled rope release device 118 in one direction while the looping motion thereof in the other direction is controlled by the frictional braking.

Figure 16:
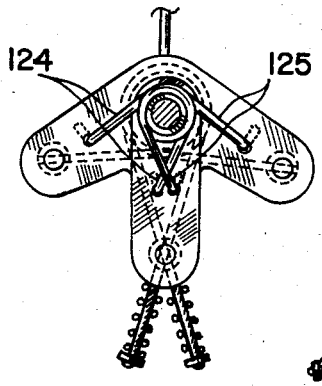
FIG. 16 illustrates a cross section equivalent to that shown in FIG. 11, of a two-way frictionally controlled rope release device wherein the braking force is substantially proportional to the difference in tensions imposed on the two members of the closed loop of rope depending therefrom.

In FIG. 16 there is illustrated a cross section equivalent to that shown in FIG. 10 of a two-way frictionally controlled rope release device constructed essentially in the same way as the device 77 shown in FIG. 9 with the following exceptions: The pivoting movement of the end plates affixed to the guide sleeve encasing the friction drum assembly is spring biased in two-ways by a pair of safety pin-like springs 124 and 125, and a pair of brake ropes instead of a single brake rope are included as shown in FIG. 17.

Figure 17:
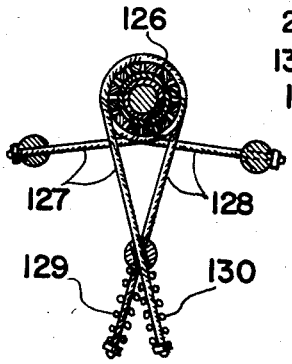
FIG. 17 illustrates another cross section equivalent to that shown in FIG. 12, of the device shown in FIG. 16.

In FIG. 17 there is illustrated another cross section equivalent to that shown in FIG. 12 of a two-way frictionally controlled rope release device described in part in conjunction with FIG. 16. The brake drum 126 is wrapped around by a pair of brake ropes 127 and 128 respectively including a pair of compression spring bias 129 and 130, each of which are installed in the same manner as that described in FIG. 11.

The two-way frictionally controlled rope release device having cross sections shown in FIGS. 16 and 17 operates much like the two-way frictionally controlled rope release device 3 or 21 respectively shown in FIGS. 2 and 3. Consequently, the two-way frictionally controlled rope release device having cross sections shown in FIGS. 16 and 17 may be used in place of the frictionally controlled rope release device 3 in constructing a one-way vertical mobility system such as the apparatus 1 shown in FIGS. 1, when the weight of the closed loop of rope 2 is heavy and the height to be covered by the two-way vertical mobility system is great.

Figure 18:
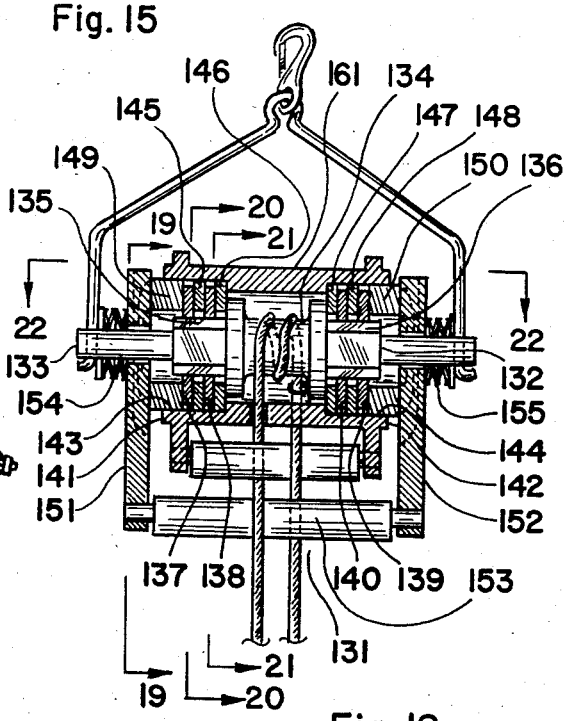
FIG. 18 illustrates a cross section of a further two-way frictionally controlled rope release device wherein the braking force is substantially proportional to the difference in tensions imposed on two members of the closed loop of rope depending therefrom.

In FIG. 18 there is illustrated a cross section of a further frictionally controlled rope release device 131 that is constructed in essentially the same way as the frictionally controlled rope release device 77 shown in FIG. 9 with the exception of brake drum assemblies. The friction drum assembly 132 rotatably mounted on a shaft 133 includes a capstan drum 134 sandwiched between two extremities having a noncircular cross section, which slidably and nonrotatably hold a plurality of brake discs 137, 138, etc. and 139, 140, etc., respectively. The extremities 141 and 142 of the guide sleeve 161 respectively include a pair of noncircular bores 143 and 144, which slidably and nonrotatably hold a plurality of brake discs 145, 146, etc. and 147, 148, etc., respectively. A pair of thrust rings 149 and 150 are slidably and nonrotatably retained in the noncircular bores 143 and 144 included in the guide sleeve 161, respectively. A pair of arms 151 and 152 depending from the shaft 133 in a pendulous relationship and rotatably and slidably supporting a roller 153 are under pressurized contact with the thrust rings 149 and 150, respectively, as those arms are spring biased by a plurality of cone washer springs 154 and 155, respectively.

Figure 19:
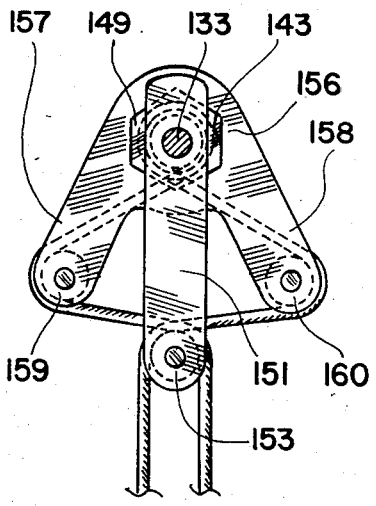
FIG. 19 illustrates a cross section of the device shown in FIG. 18.

In FIG. 19 there is illustrated a cross section of the frictionally controlled rope release device 131 shown in FIG. 18 which is taken along a plane 19—19 as shown in FIG. 18. The guide sleeve 161 includes a pair of flanges such as the element 156 rigidly affixed to two extremities thereof, respectively. Each of two flanges 156 has a pair of arms 157 and 158 extending in substantially two opposite directions, which rotatably support a pair of rollers 159 and 160 respectively secured to the extremities thereof in a rotatable relationship. The arrangements of the rollers 153, 159 and 160 are arranged in the same manner for the same purpose as those rollers 88, 97 and 98 included and described in FIG. 12.

Figure 20:
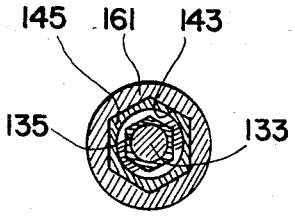
FIG. 20 illustrates another cross section of the device shown in FIG. 18.

In FIG. 20 there is illustrated a cross section of the brake discs assembly taken along a plane 20—20 as shown in FIG. 18, wherein the brake disc 145 slidably and nonrotatably held in the noncircular bore 143 in the guide sleeve 161 is shown.

Figure 21:
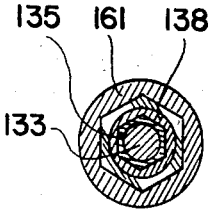
FIG. 21 illustrates a further cross section of the device shown in FIG. 18.

In FIG. 21 there is illustrated another cross section of the brake disc assembly taken along a plane 21—21 as shown in FIG. 18, wherein the brake disc 138 slidably and nonrotatably held by the noncircular section 135 of the friction drum assembly 132 is shown.

In FIG. 22 there is illustrated a cross section of the apparatus 131 taken along plane 22—22 as shown in FIG. 18. The pressurized contact between the arm 151 and the thrust ring 149 includes a cam 162 that pressurizes the brake discs assembly, when the thrust ring 149 is rotated about the shaft 133 relative to the arm 151 in either of two directions. The combination of the arm 152 and the thrust ring 150 also includes the same cam as the element 162. The frictionally controlled rope release device 131 shown in FIG. 18 becomes a two-way frictionally controlled rope release device that has the same operating principles as the apparatus described in conjunction with FIGS. 16 and 17, when it is equipped with the cam mechanism shown in FIG. 22.

Figure 23:
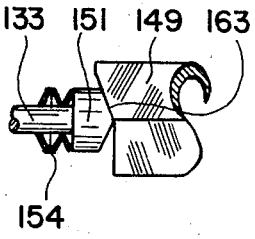
FIG. 23 illustrates a cross section equivalent to that shown in FIG. 22, of a one-way frictionally controlled rope release device having a similar construction as the device shown in FIG. 18.

In FIG. 23 there is illustrated a cross section of another embodiment of the apparatus 131 shown in FIG. 18, which cross section is equivalent to that shown in FIG. 22. The cam 163 included between the arm 151 and the thrust ring 149 is made to pressurize the brake disc assembly when the thrust ring 149 is rotated about the shaft 133 relative to the arm 151 in one direction only. Consequently, the apparatus 131 of FIG. 18 equipped with the cam mechanism shown in FIG. 23 is a one-way frictionally controlled rope release device that operates in the same principles as the apparatus 77 shown in FIG. 9. There are many other embodiments of the brake arrangement which create frictional braking substantially in proportion to the difference in tensions imposed on two rope members depending from a frictionally controlled rope release device The specific illustrative embodiments are merely to demonstrate the actual feasibility of such a brake arrangement rather than exhaustively describe such brake arrangements.

Figure 24:
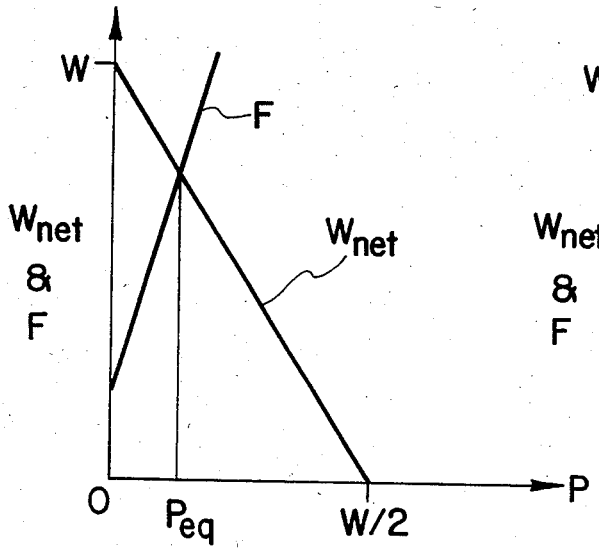
FIG. 24 illustrates the operating characteristics of a sky-ride vertical mobility system employing a frictionally controlled rope release device wherein the braking force is substantially proportional to the smaller of two tensions respectively imposed on two members of the closed loop of rope.

In FIG. 24 there is illustrated a mathematical analysis of a frictionally controlled rope release device such as those shown in FIGS. 2, 3, 4 and 6, wherein the frictional braking provided thereby is proportional to the smaller of the tensions imposed on the two rope members depending therefrom. The ordinate represents the magnitude of pull P exerted on one rope member by a person secured to the other rope member of the closed loop of rope, which is equal to the smaller of the tensions exerted on the two rope members. The abscissa represents the frictional braking F imposed on the looping motion of the closed loop of rope as well as the net weight $W_{net}$ of the person causing the lowering motion of that person which is equal to the difference between the tensions imposed on the two rope members. It is not difficult to derive the following relation:

$$W_{net} = W - 2P,$$

where W is the total weight of the person and P is the pull exerted by that person on the rope member other than the one that person is secured to. It can be easily shown that, for the braking drum assembly wherein the frictional braking is substantially proportional to the amaller of the tensions imposed on the two rope members, the friction force F is related to the pull by the following equation:

$$F = CP + F_o,$$

where C is a large constant number equal to $(e^{\mu\theta} - 1)$ which was preveously explained in conjunction with FIG. 1 and $F_o$ is a residual friction of the drum assembly that is independent of the pull P. When the aforementioned two equations are plotted on a Cartesian coordinate system, two straight lines crossing one another result as shown in FIG. 24, wherein the ordinate of the intersection between two straight lines is designated as $P_{eq}$. If the person secured to one rope member pulls the other rope member with a force equal to or greater than $P_{eq}$, that person remains suspended in midair, for the frictional braking F is equal to or greater than the net weight $W_{net}$ in that domain. If the pull P is less than $P_{eq}$, that person descends wherein, the smaller the pull, the greater the descending speed is.

Figure 25:
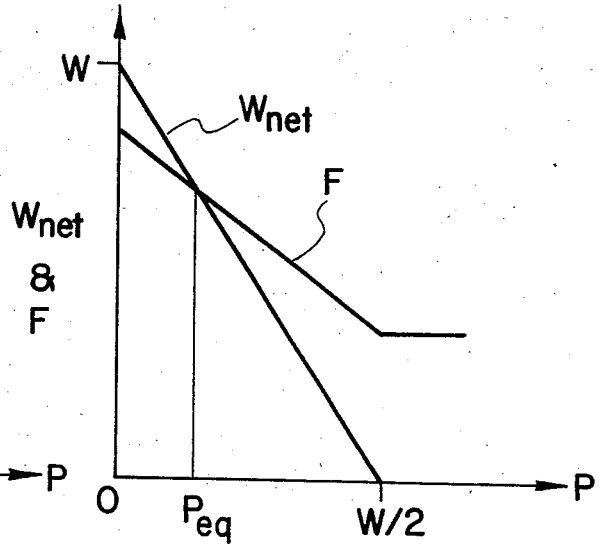
FIG. 25 illustrates the operating characteristics of a sky-ride vertical mobility system employing a frictionally controlled rope release device wherein the braking force is substantially proportional to the difference in tensions imposed on the two members of the closed loop of rope.

In FIG. 25 there is shown a mathematical analysis of another frictionally controlled rope release device such as those shown in FIGS. 9, 15, 16 and 18, wherein the frictional braking is substantially porportional to the difference in the tensions imposed on the two rope members. The straight line representing net weight $W_{net}$ is the plot of the same equation as that described in conjunciton with FIG. 24. The frictional braking is substantially propertional to the difference in the tensions imposed on the two ropes by design. By definition, the net weight $W_{net}$ is equal to the difference in the tensions imposed on the two rope members. Consequently, the frictional braking is proportional to the net weight $W_{net}$, which can be expressed in the following relation:

$$F=K(W-2P)+F_o,$$

where K is a small constant number and $F_o$ is a residual friction independent of the pull P. Other designations are the same as those defined in conjunction with FIG. 24. It is not difficult to realize that the necessary and sufficient condition for two straight lines representing the frictional braking F and the net weight $W_{net}$ to intersect one another is that the coefficient K has to be less than one, which condition must be taken into consideration in designing the friction drum employed in a frictionally controlled rope release device. It is clear from FIG. 25 that, when the pull P is equal to or greater than $P_{eq}$, which is the ordinate of the intersection between two straight lines respectively representing the frictional braking F and the net weight $W_{net}$, the person remains suspended in midair while a pull P less than $P_{eq}$ results in a descent wherein, the less the pull, the faster the descending speed is.

While the principles of the present invention have now been made clear by the illustrative embodiments, it will be immediately obvious to those skilled in the art many modifications of the arrangements, elements, proportion, structures and materials which are particularly adapted to the specific working environment and operating conditions in the practice of the invention without departing from those principles.

We claim:

1. A device for lowering a person or object from a higher elevation to a lower elevation comprising in combination:

(a) a cylindrical member secured to a supporting structure including a means for securing said supporting structure to an elevated structure, wherein said cylindrical member is rotatable in one direction and nonrotatable in the other direction opposite to said one direction;

(b) a squeezable brake lining of a substantial wall thickness enveloping the cylindrical surface of said cylindrical member in a rotatable relationship;

(c) a cord member wound on said squeezable brake lining over at least one and one half complete laps wherein one portion of said cord member extends from one side of the cylindrical surface of said squeezable brake lining and the other portion of said cord member extends from the other side of the cylindrical surface of said squeezable brake lining enveloping said cylindrical member;

(d) a cord guide means for guiding said cord member wound on said squeezable brake lining, wherein said cord guide means enhances smooth looping movement of said cord member wound on said squeezable brake lining creating rotation of said squeezable brake lining; and (e) at least one securing means affixed to said one portion of said cord member for securing a harness, wherein pull of said one portion of said cord member rotates said squeezable brake lining relative to said cylindrical member in said the other direction experiencing a braking and pull of said the other portion of said cord member rotates said squeezable brake lining and said cylindrical member together in said one direction without experiencing braking;

whereby, a person or persons wearing a harness secured to said securing means affixed to said one portion of said cord member can remain suspended in midair or lower oneself at a safe speed by exerting a small amount of pull on said the other portion of said cord member as said small amount of pull on said the other portion of said cord member produces a tension on said cord member that squeezes said squeezable brake lining on said cylindrical member, providing a frictional braking hindering rotating movements of said squeezable brake lining relative to said cylindrical member in said the other direction and, thus, providing braking on looping movement of said cord member resulting from said rotating movement of said squeezable brake lining in said the other direction, while said cord member can be looped in said one direction substantially freely after said a person or persons is detached from said one portion of said cord member.

2. The combination as set forth in claim 1 wherein extremity of said one portion of said cord member is connected to extremity of said the other portion of said cord member, wherein said cord member forms a closed loop of cord depending from said squeezable brake lining enveloping said cylindrical member.

3. The combination as set forth in claim 1 wherein said combination includes a harness securable on a person or object, said harness including a means for removably securing said harness to said at least one securing means affixed to said one portion of said cord member.

4. The combination as set forth in claim 3 wherein extremity of said one portion of said cord member is connected to extremity of said the other portion of said cord member, wherein said cord member forms a closed loop of cord depending from said squeezable brake lining enveloping said cylindrical member.

5. A device for lowering and elevating a person from a higher elevation to a lower elevation and vice versa comprising in combination:

(a) a cylindrical member secured to a supporting structure including a means for securing said supporting structure to an elevated structure, wherein said cylindrical member is rotatable in one direction and nonrotatable in the other direction opposite to said one direction;

(b) a squeezable brake lining of a substantial wall thickness enveloping the cylindrical surface of said cylindrical member in a rotatable relationship;

(c) a cord member wound on said squeezable brake lining over at least one and one half complete laps wherein one portion of said cord member extends from one side of the cylindrical surface of said squeezable brake lining and the other portion of said cord member extends from the other side of the cylindrical surface of said squeezable brake lining enveloping said cylindrical member;

(d) a cord guide means for guiding said cord member wound on said squeezable brake lining, wherein said cord guide means enhances smooth looping movement of said cord member wound on said squeezable brake lining creating rotation of said squeezable brake lining; and (e) at least one securing means affixed to said one portion of said cord member for securing a harness, wherein pull of said one portion of said cord member rotates said squeezable brake lining relative to said cylindrical member in said the other direction experiencing a braking and pull of said the other portion of said cord member rotates said squeezable brake lining and said cylindrical member together in said one direction without experiencing braking;

(f) at least one stirrup means slidably secured to said the other portion of said cord member, said at least one stirrup means including a pressure activated grip means, wherein said pressure activated grip means grabs said cord member in a nonslidable relationship when said at least one stirrup means is stepped on, while said at least one stirrup means slides substantially freely on said cord member when said at least one stirrup means is not stepped on;

whereby, a person wearing harness secured to said securing means affixed to said one portion of said cord member can remain suspended in midair or lower oneself at a safe speed by exerting a small amount of pull on said the other portion of said cord member as said small amount of pull provides a frictional braking on the rotational movement of said squeezable brake lining relative to said cylindrical member and controls looping motion of said cord member in said the other direction, while said person can elevate oneself by repeating the combination of movements of standing up on said at least one stirrup means and then pulling up said at least one stirrup means by bending knees while maintaining a small amount of pull on said the other portion of said cord member as said movements create a looping movement of said cord member in said one direction without experiencing said frictional braking.

6. The combination as set forth in claim 5 wherein extremity of said one portion of said cord member is connected to extremity of said the other portion of said cord member, wherein said cord member forms a closed loop of cord depending from said squeezable brake lining enveloping said cylindrical member.

7. The combination as set forth in claim 5 wherein said combination includes a harness securable on a person or object, said harness including a means for removably securing said harness to said at least one securing means affixed to said one portion of said cord member.

8. The combination as set forth in claim 7 wherein extremity of said one portion of said cord member is connected to extremity of said the other portion of said cord member, wherein said cord member forms a closed loop of cord depending from said squeezable brake lining enveloping said cylindrical member.

* * * * *